US009981490B2

(12) United States Patent
Inoue et al.

(10) Patent No.: US 9,981,490 B2
(45) Date of Patent: May 29, 2018

(54) PRINT SYSTEM INCLUDING MULTIPLE PRINTERS

(71) Applicant: RISO KAGAKU CORPORATION, Tokyo (JP)

(72) Inventors: Hideaki Inoue, Ibaraki (JP); Hirokazu Yabune, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days. days.

(21) Appl. No.: 15/378,625

(22) Filed: Dec. 14, 2016

(65) Prior Publication Data

US 2017/0182810 A1 Jun. 29, 2017

(30) Foreign Application Priority Data

Dec. 28, 2015 (JP) ..... 2015-256762

(51) Int. Cl.

| | |
|---|---|
| ***B41J 2/165*** | (2006.01) |
| ***B41J 13/32*** | (2006.01) |
| ***B41J 2/01*** | (2006.01) |
| ***B41J 3/54*** | (2006.01) |
| ***B41J 3/60*** | (2006.01) |
| ***B41J 11/00*** | (2006.01) |
| ***B41J 13/00*** | (2006.01) |
| ***B41J 13/28*** | (2006.01) |

(52) U.S. Cl.

CPC ..... *B41J 13/32* (2013.01); *B41J 2/01* (2013.01); *B41J 3/54* (2013.01); *B41J 3/60* (2013.01); *B41J 11/0095* (2013.01); *B41J 13/0009* (2013.01); *B41J 13/009* (2013.01); *B41J 13/0018* (2013.01); *B41J 13/0045* (2013.01); *B41J 13/28* (2013.01)

(58) Field of Classification Search

None

See application file for complete search history.

(56) References Cited

U.S. PATENT DOCUMENTS

| | | | | |
|---|---|---|---|---|
| 4,579,446 | A * | 4/1986 | Fujino | G03G 15/238 271/185 |
| 9,168,762 | B2 | 10/2015 | Nakamura et al. | |
| 2015/0352865 | A1 * | 12/2015 | Taniguchi | B41J 13/0009 347/16 |

FOREIGN PATENT DOCUMENTS

| | | |
|---|---|---|
| JP | 2012-143964 | 8/2012 |

OTHER PUBLICATIONS

Extended European Search Report for EP 16204995.1 dated Jun. 29, 2017.

* cited by examiner

*Primary Examiner* — Alejandro Valencia
(74) *Attorney, Agent, or Firm* — Greenblum & Bernstein, P.L.C.

(57) ABSTRACT

A print system includes a first printer which performs printing on a sheet while conveying the sheet and a second printer which receives the sheet conveyed from the first printer and performs printing on the sheet while conveying the sheet. The second printer includes a second printing unit, a second registration roller, a second pre-registration roller, a sheet detector, and a second controller. The second controller controls an operation of the second pre-registration roller and an operation of the second registration roller based on a timing of a detection of the sheet by the sheet detector.

3 Claims, 6 Drawing Sheets

PRINT SYSTEM INCLUDING MULTIPLE PRINTERS

CROSS REFERENCE TO RELATED APPLICATION

This application is based upon and claims the benefit of priority from the prior Japanese Patent Application No. 2015-256762, filed on Dec. 28, 2015, the entire contents of which are incorporated herein by reference.

BACKGROUND

1. Technical Field

The disclosure relates to a print system including multiple printers.

2. Related Art

A print system in which multiple printers are connected in series (in tandem) is known.

Japanese Unexamined Patent Application Publication No. 2012-143964 discloses a print system in which two printers are connected in tandem. When duplex printing is performed in this print system, the upstream printer performs printing on the front side of a sheet and then an intermediate device arranged between the printers turns over the sheet and sends the sheet to the downstream printer. Then, the downstream printer performs printing on the back side of the sheet. The productivity of printed sheets can be thereby improved compared to the case where the duplex printing is performed by using one printer.

SUMMARY

The print system described above uses, for example, the printers which correct skewing of the sheet by causing the sheet to abut on registration rollers arranged upstream of a printing unit, then convey the sheet to the printing unit by driving the registration rollers, and perform printing on the sheet. In these printers, controllers perform conveyance operation control of the sheet based on drive start timings of the registration rollers which come at predetermined time intervals.

In the print system in which multiple printers are connected, each of the printers has an individual controller. When the controllers of the respective printers perform the aforementioned conveyance operation control based on the drive start timing of the registration rollers, a timing when the sheet arrives at any of the printers other than the most-upstream one sometimes differ from a timing appropriate for the conveyance operation control of the printer. This may cause sheet jam and lead to operation stop. As a result, the productivity of printed sheets may decrease.

An object of the disclosure is to provide a print system capable of suppressing a decrease in productivity of printed sheets.

A print system in accordance with some embodiments includes: a first printer configured to perform printing on a sheet while conveying the sheet; and a second printer configured to receive the sheet conveyed from the first printer and perform printing on the sheet while conveying the sheet. The first printer includes: a first printing unit configured to perform the printing on the sheet; a first registration roller configured to convey the sheet to the first printing unit; at least one first pre-registration roller configured to convey the sheet to the first registration roller; and a first controller configured to control the first printing unit, the first pre-registration roller, and the first registration roller, the first controller configured to drive the first pre-registration roller to allow the sheet to abut on the first registration roller and then drive the first registration roller to convey the sheet to the first printing unit while driving the first pre-registration roller to assist conveyance of the sheet by the first registration roller. The second printer includes: a second printing unit configured to perform the printing on the sheet; a second registration roller configured to convey the sheet to the second printing unit; at least one second pre-registration roller configured to convey the sheet to the second registration roller; a sheet detector arranged upstream of the second registration roller in a sheet conveyance direction and configured to detect the sheet; and a second controller configured to control the second printing unit, the second pre-registration roller, and the second registration roller, the second controller configured to drive the second pre-registration roller to allow the sheet to abut on the second registration roller and then drive the second registration roller to convey the sheet to the second printing unit while driving the second pre-registration roller to assist conveyance of the sheet by the second registration roller. The second controller is configured to control an operation of the second pre-registration roller and an operation of the second registration roller based on a timing of a detection of the sheet by the sheet detector.

In the configuration described above, in the second printer which is a printer other than the first printer being the most-upstream printer, the second pre-registration rollers and the second registration rollers can be operated in synchronization with a timing at which the sheet arrives. Accordingly, it is possible to reduce sheet jam caused by a difference between the timing at which the conveyed sheet arrives and an operation timing of the second pre-registration rollers and the second registration rollers. As a result, it is possible to reduce operation stop due to sheet jam and thereby suppress a decrease in productivity of printed sheets.

The print system may further include at least one intermediate device arranged between the first printer and the second printer and configured to convey the sheet between the first printer and the second printer. The at least one intermediate device may include: at least one conveyance roller configured to convey the sheet to the second printer arranged downstream of and adjacent to the at least one intermediate device; and an intermediate device controller configured to control the conveyance roller. The intermediate device controller may be configured to drive the at least one conveyance roller to perform an operation of allowing the sheet to abut on the second registration roller and an operation of assisting the conveyance of the sheet by the second registration roller in synchronization with the operation of the second pre-registration roller, depending on a size of the sheet.

In the configuration described above, slack and stretch in the sheet held by both the conveyance rollers and the second pre-registration rollers can be reduced. As a result, the sheet jam can be further reduced.

DETAILED DESCRIPTION

Figure 1:
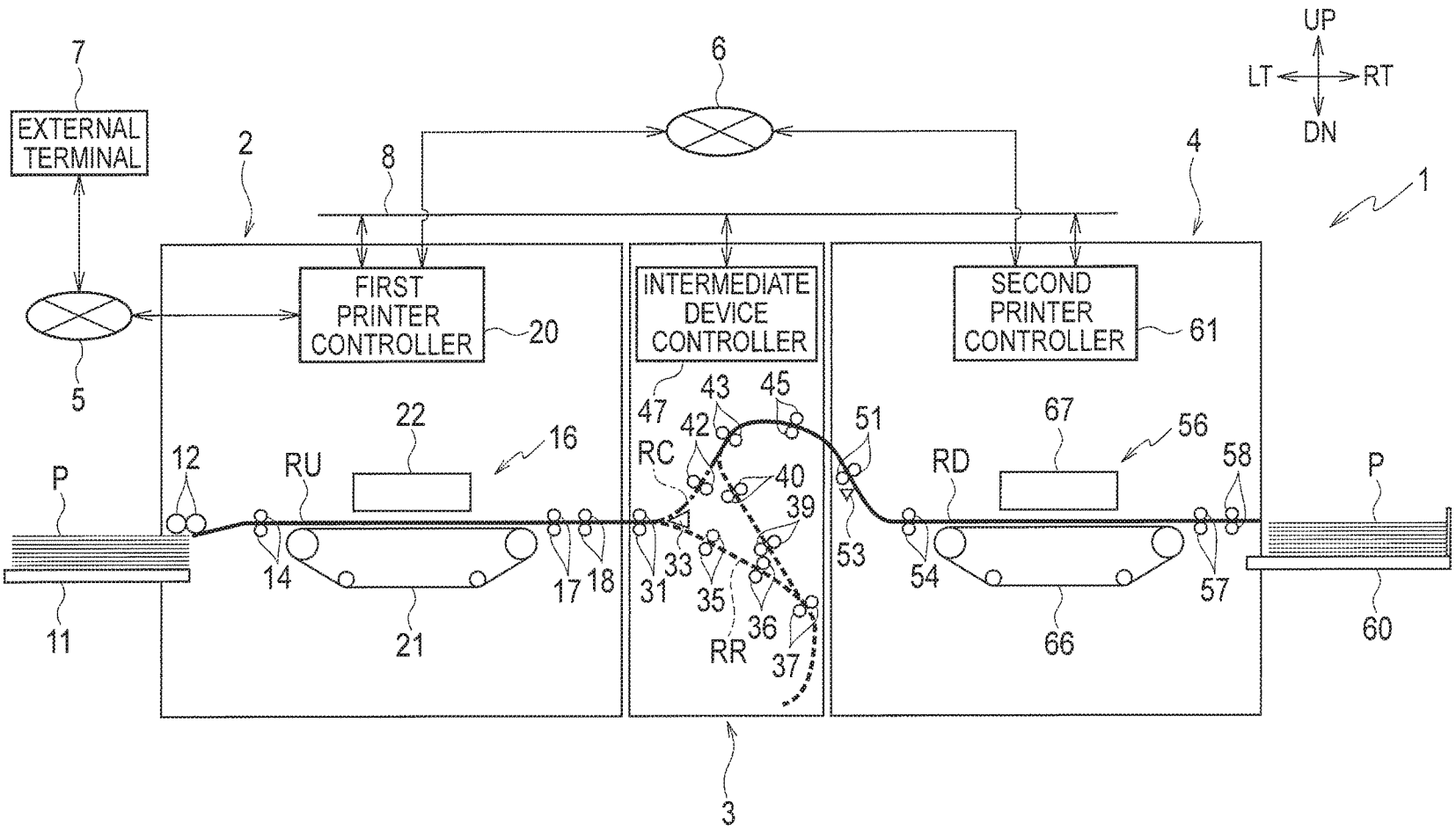
FIG. 1 is a schematic configuration diagram of a print system according to an embodiment.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for embodiments of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

Figure 2:
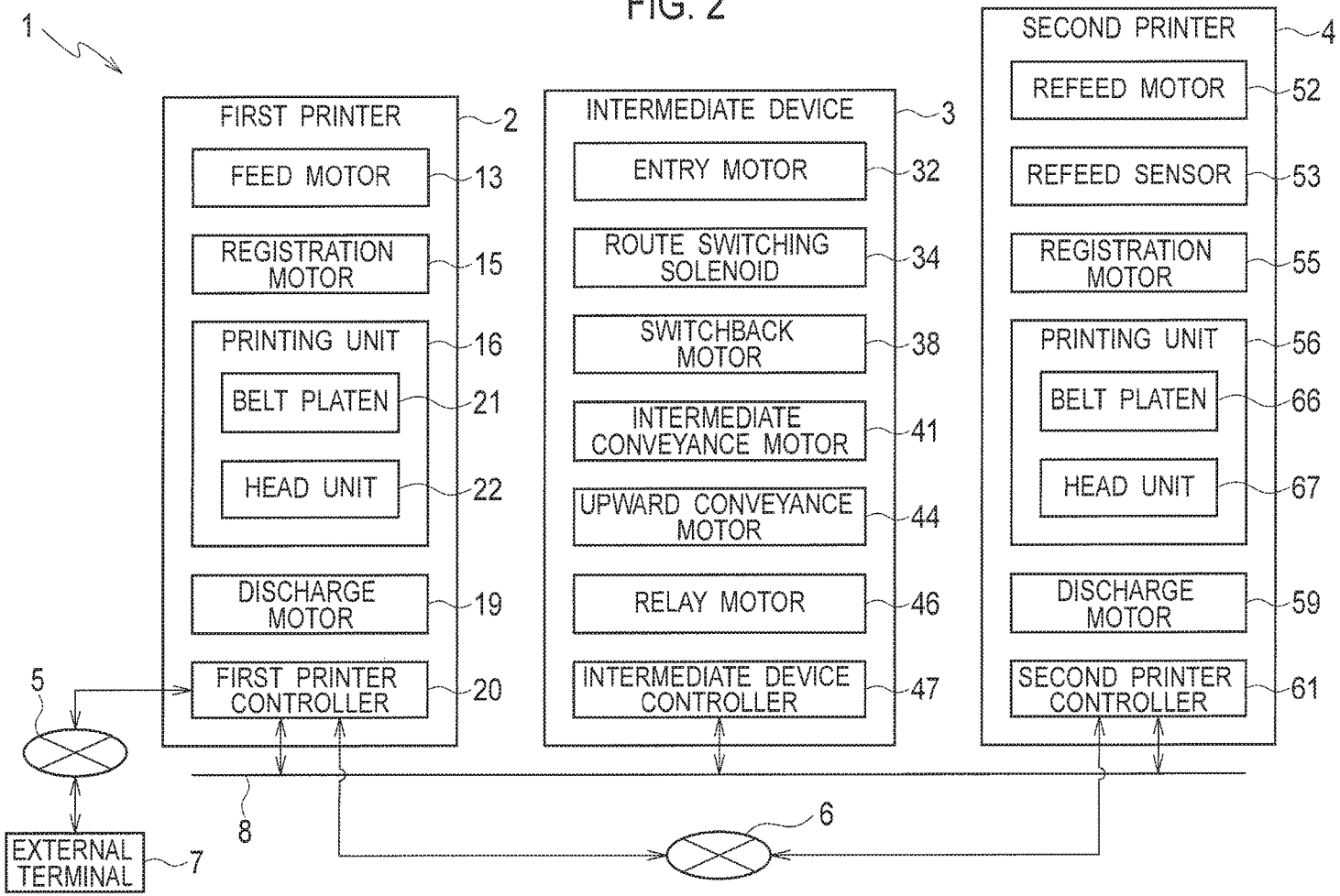
FIG. 2 is a control block diagram of a print system illustrated in FIG. 1.

FIG. 1 is a schematic configuration diagram of a print system 1 according to an embodiment of the present invention. FIG. 2 is a control block diagram of the print system 1 illustrated in FIG. 1. In the following description, a direction orthogonal to the sheet surface of FIG. 1 is referred to as a front-rear direction. Moreover, in FIG. 1, directions of right, left, up, and down are denoted by RT, LT, UP, and DN, respectively.

A route illustrated by bold lines in FIG. 1 is a conveyance route through which a sheet P being a print medium is conveyed. In the conveyance route, routes illustrated by solid lines are an upstream conveyance route RU and a downstream conveyance route RD, a route illustrated by broken lines is a turn-over route RR, and a route illustrated by a one-dot chain line is a non-turn-over intermediate route RC. Upstream and downstream in the following description mean upstream and downstream in a conveyance direction on the conveyance route.

As illustrated in FIGS. 1 and 2, the print system 1 includes a first printer 2, an intermediate device 3, and a second printer 4. The print system 1 is a tandem print system which performs printing on the sheet P by conveying the sheet P sequentially to the first printer 2 and the second printer 4.

The first printer 2 prints an image on the sheet P and sends the sheet P out to the intermediate device 3. The first printer 2 includes a paper feed tray 11, paper feed rollers 12 (pre-registration rollers), a feed motor 13, registration rollers 14, a registration motor 15, a printing unit 16, paper discharge rollers 17 and 18, a discharge motor 19, and a first printer controller 20.

The paper feed tray 11 is a tray on which the sheets P used in the printing are stacked.

The paper feed rollers 12 pick up the sheets P stacked on the paper feed tray 11 one by one and convey each sheet P to the registration rollers 14. Moreover, the paper feed rollers 12 perform an assisting operation of assisting conveyance of the sheet P by the registration rollers 14. The paper feed rollers 12 are arranged in an upstream end portion of the upstream conveyance route RU.

The feed motor 13 rotationally drives the paper feed rollers 12.

The registration rollers 14 convey the sheet P conveyed from the paper feed rollers 12 toward the printing unit 16 after the sheet P abuts on the registration rollers 14 and a slack is formed in the sheet P.

The registration motor 15 rotationally drives the registration rollers 14.

The printing unit 16 prints an image on the sheet P while conveying the sheet P. The printing unit 16 includes a belt platen 21 and a head unit 22.

The belt platen 21 conveys the sheet P conveyed from the registration rollers 14 while sucking and holding the sheet P on a belt.

The head unit 22 prints an image on the sheet P conveyed by the belt platen 21 by ejecting ink onto the sheet P. The head unit 22 includes an inkjet head (not illustrated) having multiple nozzles arranged in the front-rear direction and ejects the ink to the sheet P from the nozzles of the inkjet head.

The paper discharge rollers 17 and 18 discharge the sheet P conveyed from the belt platen 21, to the intermediate device 3.

The discharge motor 19 rotationally drives the paper discharge rollers 17 and 18.

The first printer controller 20 controls operations of the units of the first printer 2. The first printer controller 20 includes a CPU, a RAM, a ROM, a hard disk drive, and the like. The first printer controller 20 can communicate with an external terminal 7 including a personal computer and the like via a first network 5 including a LAN and the like. Moreover, the first printer controller 20 can communicate with a second printer controller 61 of the second printer 4 to be described later via a second network 6 including a LAN and the like. Furthermore, the first printer controller 20 can communicate with an intermediate device controller 47 of the intermediate device 3 to be described later and the second printer controller 61 of the second printer 4 via a communication line 8.

In the printing in the first printer 2, the first printer controller 20 performs control such that the paper feed rollers 12 pick up each sheet P from the paper feed tray 11 and cause the sheet P to abut on the registration rollers 14. Thereafter, the first printer controller 20 performs control such that the registration rollers 14 are driven to convey the sheet P to the printing unit 16 with the assistance of the paper feed rollers 12. Then, the first printer controller 20 performs control such that, in the printing unit 16, the head unit 22 prints an image on the sheet P while the belt platen 21 conveys the sheet P.

The intermediate device 3 conveys the sheet P between the first printer 2 and the second printer 4. The intermediate device 3 is arranged downstream (on the right side) of and adjacent to the first printer 2. The intermediate device 3 includes entry rollers 31, an entry motor 32, a route switching flipper 33, a route switching solenoid 34, turn-over rollers 35 and 36, switchback rollers 37, a switchback motor 38, intermediate rollers 39 and 40, an intermediate conveyance motor 41, face-up rollers 42, upward conveyance rollers 43, an upward conveyance motor 44, relay rollers 45 (conveyance rollers), a relay motor 46, and the intermediate device controller 47.

The entry rollers 31 take the sheet P discharged from the first printer 2 into the intermediate device 3. The entry rollers 31 are arranged in a downstream end portion of the upstream conveyance route RU which is an upstream end portion of the conveyance route in the intermediate device 3.

The entry motor 32 rotationally drives the entry rollers 31, the turn-over rollers 35, and the face-up rollers 42.

The route switching flipper 33 switches the course of the sheet P conveyed along the upstream conveyance route RU between the turn-over route RR and the non-turn-over intermediate route RC.

The route switching solenoid 34 drives the route switching flipper 33.

The turn-over rollers 35 and 36 convey the sheet P guided to the turn-over route RR by the route switching flipper 33, to the switchback rollers 37.

The switchback rollers 37 switch-back the sheet P conveyed by the turn-over rollers 35 and 36 and convey the sheet P to the intermediate rollers 39. The switchback rollers 37 are capable of rotating in normal and reverse directions to perform the switchback of the sheet P.

The switchback motor 38 rotationally drives the switchback rollers 37 in the normal and reverse directions.

The intermediate rollers 39 and 40 convey the sheet P switched back by the switchback rollers 37 to the upward conveyance rollers 43.

The intermediate conveyance motor 41 rotationally drives the turn-over rollers 36 and the intermediate rollers 39 and 40.

The face-up rollers 42 convey the sheet P guided to the non-turn-over intermediate route RC by the route switching flipper 33, to the upward conveyance rollers 43.

The upward conveyance rollers 43 convey the sheet P conveyed from the intermediate rollers 40 or the face-up rollers 42, to the relay rollers 45. The upward conveyance rollers 43 are arranged on the downstream conveyance route RD, downstream of and close to a point where the turn-over route RR and the non-turn-over intermediate route RC merge with each other.

The upward conveyance motor 44 rotationally drives the upward conveyance rollers 43.

The relay rollers 45 convey the sheet P conveyed from the upward conveyance rollers 43, to the second printer 4.

The relay motor 46 rotationally drives the relay rollers 45.

The intermediate device controller 47 controls operations of the units of the intermediate device 3. The intermediate device controller 47 includes a CPU, a RAM, a ROM, a hard disk drive, and the like. The intermediate device controller 47 can communicate with the first printer controller 20 of the first printer 2 and the second printer controller 61 of the second printer 4 to be described later via the communication line 8.

The second printer 4 prints an image on the sheet P conveyed from the intermediate device 3. The second printer 4 is arranged downstream (on the right side) of and adjacent to the intermediate device 3. The second printer 4 includes paper refeed rollers 51 (pre-registration rollers), a refeed motor 52, a refeed sensor 53 (sheet detector), registration rollers 54, a registration motor 55, a printing unit 56, paper discharge rollers 57 and 58, a discharge motor 59, a paper receiving tray 60, and the second printer controller 61.

The paper refeed rollers 51 convey the sheet P conveyed from the relay rollers 45 of the intermediate device 3, to the registration rollers 54. Moreover, the paper refeed rollers 51 perform an assisting operation of assisting conveyance of the sheet P by the registration rollers 54. The paper refeed rollers 51 are arranged in an upstream end portion of the downstream conveyance route RD in the second printer 4.

The refeed motor 52 rotationally drives the paper refeed rollers 51.

The refeed sensor 53 detects the sheet P conveyed from the paper refeed rollers 51 toward the registration rollers 54. The refeed sensor 53 is arranged upstream of the registration rollers 54, downstream of and close to the paper refeed rollers 51.

The registration rollers 54 convey the sheet P conveyed from the paper refeed rollers 51 toward the printing unit 56 after the sheet P abuts on the registration rollers 54 and a slack is formed in the sheet P.

The registration motor 55 rotationally drives the registration rollers 54.

The printing unit 56 prints an image on the sheet P while conveying the sheet P. The printing unit 56 includes a belt platen 66 and a head unit 67.

The belt platen 66 and the head unit 67 have the same configurations as the belt platen 21 and the head unit 22 of the first printer 2 described above, respectively.

The paper discharge rollers 57 and 58 discharge the sheet P conveyed from the belt platen 66, to the paper receiving tray 60.

The discharge motor 59 rotationally drives the paper discharge rollers 57 and 58.

The paper receiving tray 60 holds the sheet P discharged by the paper discharge rollers 57 and 58.

The second printer controller 61 controls operations of the units of the second printer 4. The second printer controller 61 includes a CPU, a RAM, a ROM, a hard disk drive, and the like. The second printer controller 61 can communicate with the first printer controller 20 of the first printer 2 via the second network 6. Moreover, the second printer controller 61 can communicate with the first printer controller 20 of the first printer 2 and the intermediate device controller 47 of the intermediate device 3 via the communication line 8.

In the printing in the second printer 4, the second printer controller 61 performs control such that the paper refeed rollers 51 cause the sheet P conveyed from the intermediate device 3 to abut on the registration rollers 54. Thereafter, the second printer controller 61 performs control such that the registration rollers 54 are driven to convey the sheet P to the printing unit 56 with the assistance of the paper refeed rollers 51. In this case, the second printer controller 61 controls the operations of the paper refeed rollers 51 and the registration rollers 54 based on a timing at which the refeed sensor 53 detects the sheet P. Then, the second printer controller 61 performs control such that, in the printing unit 56, the head unit 67 prints an image on the sheet P while the belt platen 66 conveys the sheet P.

Next, operations in the case where duplex printing is performed in the print system 1 are described.

The operation of duplex printing in the print system 1 starts when the first printer controller 20 receives a print job of duplex printing from the external terminal 7 via the first network 5.

When receiving the print job, the first printer controller 20 starts the drive of the belt platen 21 and the paper discharge rollers 17 and 18.

Moreover, when receiving the print job, the first printer controller 20 sends the received print job to the second printer controller 61 via the second network 6. Furthermore, the first printer controller 20 sends a preparation signal for instructing start of preparation of duplex printing to the intermediate device controller 47 via the communication line 8.

When receiving the print job, the second printer controller 61 starts the drive of the paper refeed rollers 51, the belt platen 66, and the paper discharge rollers 57 and 58.

When receiving the preparation signal, the intermediate device controller 47 starts the drive of the entry rollers 31, the turn-over rollers 35 and 36, the switchback rollers 37, the intermediate rollers 39 and 40, the upward conveyance rollers 43, and the relay rollers 45. Moreover, the intermediate device controller 47 sets the route switching flipper 33 such that the sheet P is guided in a direction from the upstream conveyance route RU to the turn-over route RR.

The first printer controller 20 starts feeding the sheet P from the paper feed tray 11 to the printing unit 16 after starting the drive of the belt platen 21 and the paper discharge rollers 17 and 18.

Figure 3:
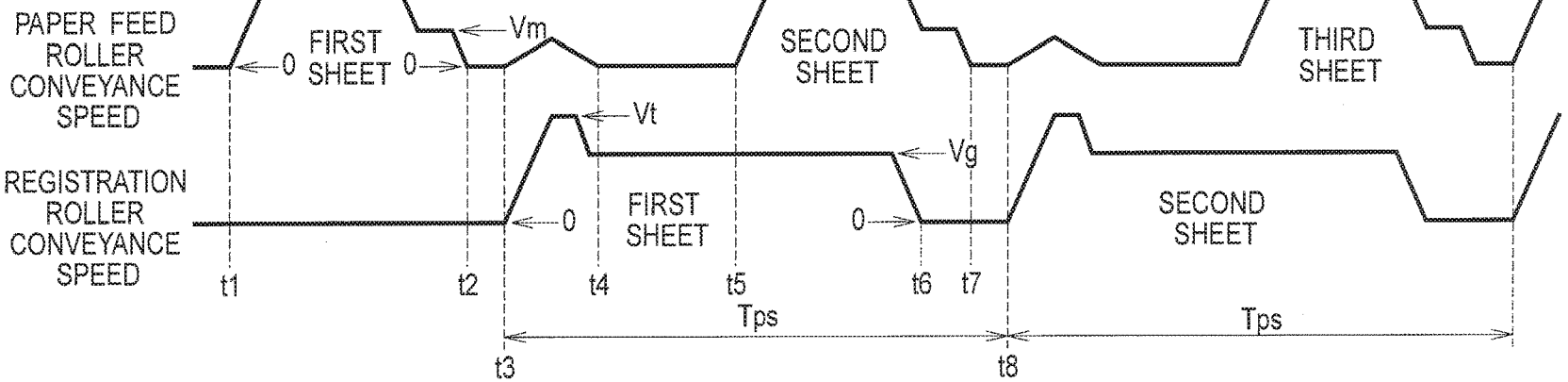
FIG. 3 is a time chart for explaining operations of paper feed rollers and registration rollers in a first printer.

FIG. 3 is a time chart for explaining operations of the paper feed rollers 12 and the registration rollers 14 in the paper feeding. As illustrated in FIG. 3, first, the first printer controller 20 starts the drive of the paper feed rollers 12 (time t1 of FIG. 3). When the conveyance speed by the paper feed rollers 12 reaches a paper feed conveyance speed Vk set in advance, the first printer controller 20 maintains the conveyance speed at the paper feed conveyance speed Vk from that moment.

When a predetermined deceleration start timing comes, the first printer controller 20 starts to reduce the conveyance speed by the paper feed rollers 12 from the paper feed conveyance speed Vk. When the conveyance speed by the paper feed rollers 12 is reduced to an abutting speed Vm, the first printer controller 20 maintains the conveyance speed at the abutting speed Vm from that moment. The abutting speed Vm is a speed set in advance as a conveyance speed at which the sheet P is to abut on the registration rollers 14. The sheet P abuts on the registration rollers 14 while being conveyed at the abutting speed Vm.

When a distance conveyed at the abutting speed Vm reaches a distance set in advance, the first printer controller 20 starts to reduce the conveyance speed by the paper feed rollers 12 from the abutting speed Vm. Then, the first printer controller 20 stops the paper feed rollers 12 (time t2 of FIG. 3). The sheet P thereby stops in a state abutting on the registration rollers 14 with a slack formed. As a result, skewing of the sheet P is corrected.

When a predetermined time elapses from the stop of the paper feed rollers 12, the first printer controller 20 starts the drive of the registration rollers 14 (time t3 of FIG. 3). Thereafter, the first printer controller 20 increases the conveyance speed by the registration rollers 14 to a top speed Vt, maintains the conveyance speed at the top speed Vt for a predetermined time, and then reduces the conveyance speed to a print conveyance speed Vg. The top speed Vt is a speed set in advance as a speed for maintaining an interval between multiple sheets P in the case where the multiple sheets P are continuously fed. The print conveyance speed Vg is a conveyance speed of the sheet P by the belt platen 21.

The first printer controller 20 reduces the speed of the registration rollers 14 to the print conveyance speed Vg before a leading edge of the sheet P reaches the belt platen 21. When the conveyance speed by the registration rollers 14 is reduced to the print conveyance speed Vg, the first printer controller 20 maintains the conveyance speed at the print conveyance speed Vg from that moment.

Moreover, the first printer controller 20 starts the assisting operation by the paper feed rollers 12 simultaneously with the drive start of the registration rollers 14. Specifically, the first printer controller 20 starts the drive of the paper feed rollers 12 simultaneously with the drive start of the registration rollers 14 (time t3 of FIG. 3). Next, the first printer controller 20 increases the conveyance speed by the paper feed rollers 12 to a predetermined speed and then reduces the conveyance speed to stop the paper feed rollers 12 (time t4 of FIG. 3). The assisting operation by the paper feed rollers 12 is thereby completed. The assisting operation completes before a trailing edge of the sheet P passes the paper feed rollers 12. This prevents the paper feed rollers 12 from erroneously conveying the next sheet P.

After the completion of the assisting operation, the first printer controller 20 starts the drive of the paper feed rollers 12 to feed the next sheet P (time t5 of FIG. 3). Thereafter, the first printer controller 20 operates the paper feed rollers 12 as in the operations in the times t1 to t2 described above.

Meanwhile, when the trailing edge of the sheet P passes the registration rollers 14, the first printer controller 20 stops the registration rollers 14 (time t6 of FIG. 3). Thereafter, the paper feed rollers 12 cause the next sheet P to abut on the registration roller 14 and stop (time t7 of FIG. 3).

When the predetermined time elapses from the stop of the paper feed rollers 12, the first printer controller 20 starts the drive of the registration rollers 14 (time t8 of FIG. 3). Thereafter, the first printer controller 20 operates the registration rollers 14 as in the operations in the times t3 to t6 described above. Moreover, the first printer controller 20 starts the assisting operation by the paper feed rollers 12 simultaneously with the drive start of the registration rollers 14. Then, the first printer controller 20 operates the paper feed rollers 12 as in the assisting operation in the times t2 to t4 described above.

The sheets P are sequentially conveyed to the printing unit 16 by repeating such operations of the paper feed rollers 12 and the registration rollers 14.

In this case, a drive start timing of the registration rollers 14 is set to a timing which comes every print time Tps for one page as illustrated in FIG. 3. The operation control of the paper feed rollers 12 described above is performed based on the thus-set drive start timing of the registration rollers 14.

The sheet P conveyed to the printing unit 16 is subjected to printing on the front side by the head unit 22 while being conveyed by the belt platen 21. The sheet P subjected to printing by the printing unit 16 is discharged to the intermediate device 3 by the paper discharge rollers 17 and 18.

In the intermediate device 3, the sheet P is received and conveyed by the entry rollers 31 and is guided from the upstream conveyance route RU to the turn-over route RR by the route switching flipper 33. The sheet P guided to the turn-over route RR is conveyed to the switchback rollers 37 by the turn-over rollers 35 and 36 and switched back by the switchback rollers 37. The switched-back sheet P is conveyed by the intermediate rollers 39 and 40, the upward conveyance rollers 43, and the relay rollers 45 and sent out to the second printer 4. Switching back the sheet P in the intermediate device 3 causes the sheet P to be sent out to the second printer 4 in a turned-over state.

The sheet P sent out from the intermediate device 3 to the second printer 4 is received and conveyed by the paper refeed rollers 51 and abuts on the registration rollers 54. Thereafter, the sheet P is conveyed to the printing unit 56 by the registration rollers 54. In this case, the paper refeed rollers 51 perform the assisting operation of assisting the conveyance of the sheet P by the registration rollers 54.

The operations of the paper refeed rollers 51 and the registration rollers 54 are controlled based on a timing at which the refeed sensor 53 detects a sheet leading edge. Moreover, in the case where the size of the sheet P is equal to or greater than the predetermined size, the relay rollers 45 perform a deceleration abutting operation and the assisting operation in synchronization with the paper refeed rollers 51. Specifically, in the case where the size of the sheet P is such a size that a trailing edge portion of the sheet P does not pass the relay rollers 45 (is nipped by the relay rollers 45)

when the sheet P abuts on the registration rollers 54, the relay rollers 45 operate in synchronization with the paper refeed rollers 51 until the sheet P passes the relay rollers 45.

Description is given of operations of the relay rollers 45, the paper refeed rollers 51, and the registration rollers 54 in the case where the size of the sheet P is equal to or greater than the predetermined size.

Figure 4:
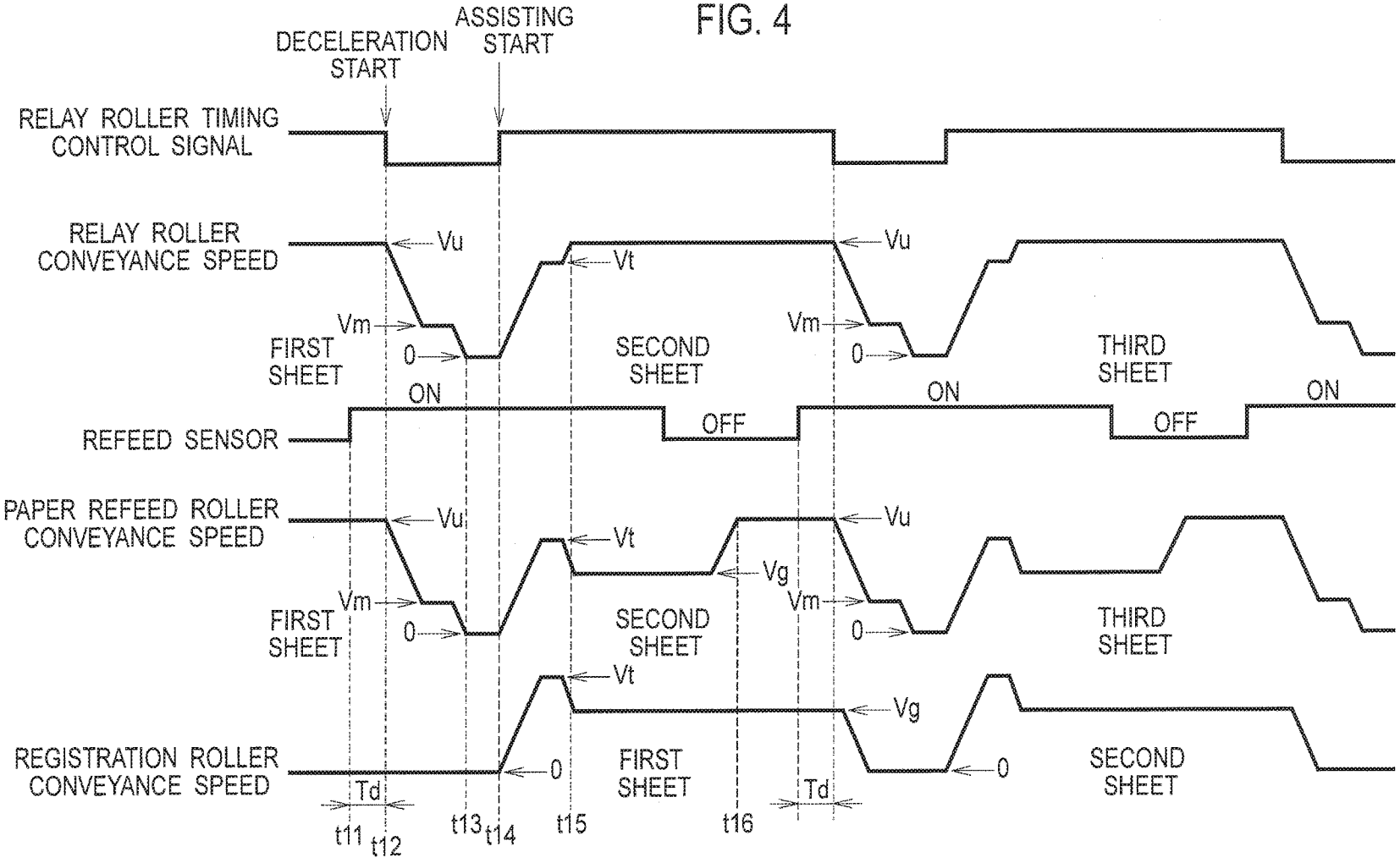
FIG. 4 is a time chart for explaining operations of relay rollers in an intermediate device and paper refeed rollers and registration rollers in a second printer.
Figure 5:
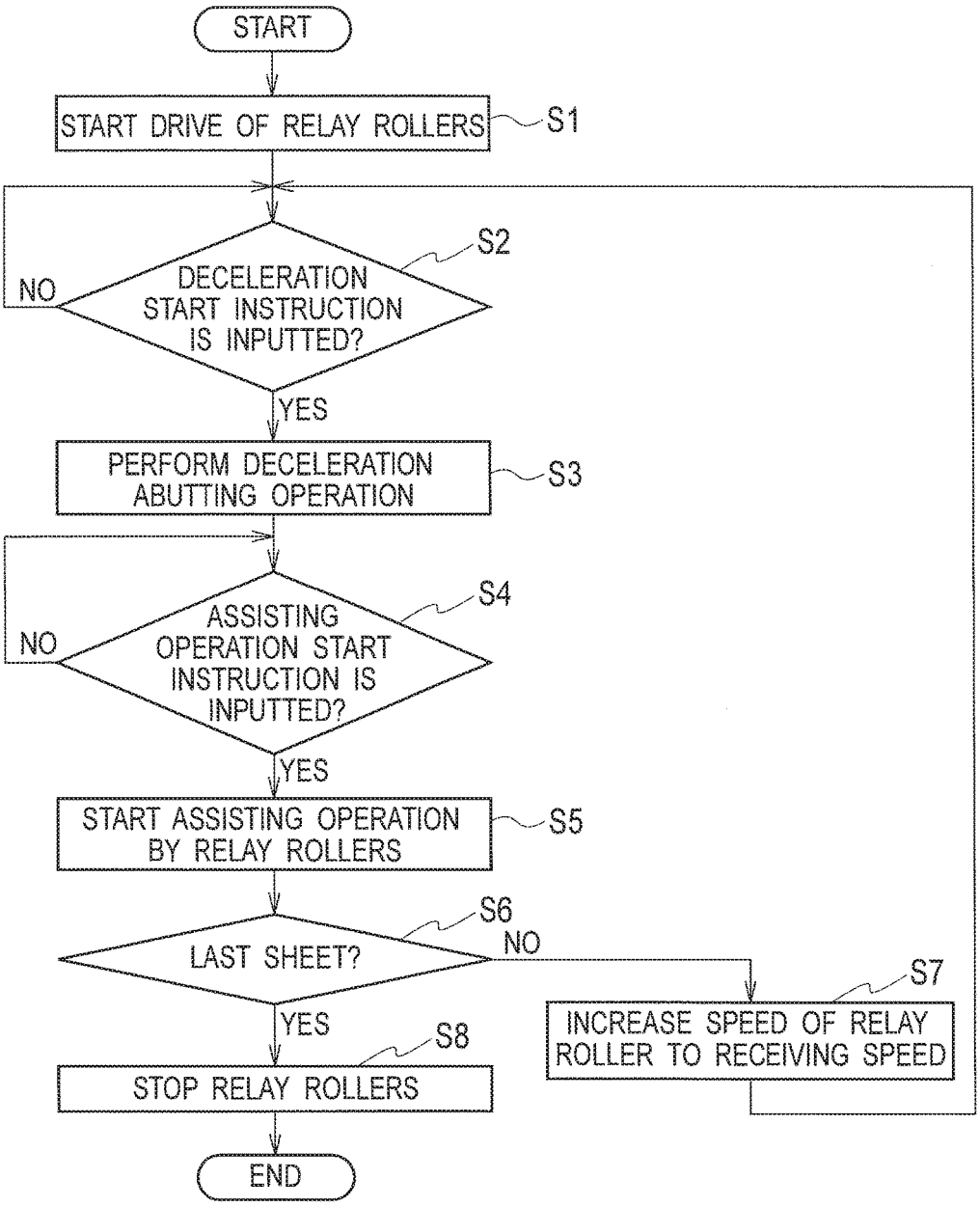
FIG. 5 is a flowchart depicting control of operations of the relay rollers in the intermediate device.
Figure 6:
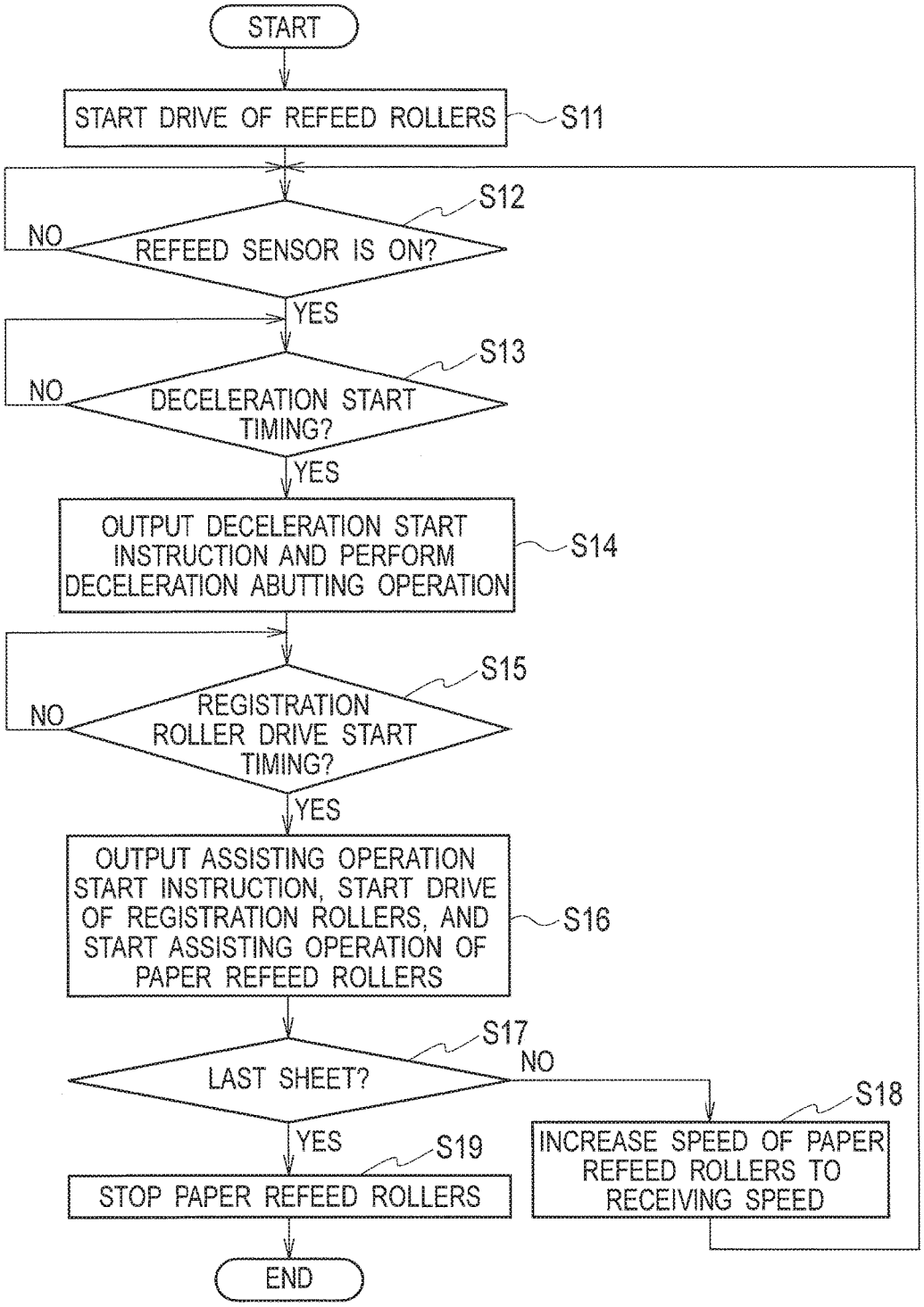
FIG. 6 is a flowchart depicting control of operations of the paper refeed rollers and the registration rollers in the second printer.

FIG. 4 is a time chart for explaining the operations of the relay rollers 45, the paper refeed rollers 51, and the registration rollers 54 in this case. FIG. 5 is a flowchart depicting control of the operations of the relay rollers 45 in this case. FIG. 6 is a flowchart depicting control of the operations of the paper refeed rollers 51 and the registration rollers 54 in this case.

In step S1 of FIG. 5, when the intermediate device controller 47 receives the preparation signal, the intermediate device controller 47 starts the drive of the relay rollers 45 and causes the relay rollers 45 to be driven at a predetermined receiving speed Vu. Meanwhile, in step S11 of FIG. 6, when the second printer controller 61 receives the print job, the second printer controller 61 starts the drive of the paper refeed rollers 51 and causes the paper refeed rollers 51 to be driven at the receiving speed Vu. When the sheet P is conveyed to the relay rollers 45 and the paper refeed rollers 51, the relay rollers 45 and the paper refeed rollers 51 receive and convey the sheet P at the receiving speed Vu.

After the drive start of the paper refeed rollers 51, in step S12 of FIG. 6, the second printer controller 61 determines whether the refeed sensor 53 is on. In this case, the refeed sensor 53 turns on when detecting the sheet leading edge. When the second printer controller 61 determines that the refeed sensor 53 is not on (step S12: NO), the second printer controller 61 repeats step S12.

When the second printer controller 61 determines that the refeed sensor 53 is on (time t11 of FIG. 4) (step S12: YES), in step S13 of FIG. 6, the second printer controller 61 determines whether it is the deceleration start timing. The deceleration start timing is a timing after a specified time Td elapses from the timing at which the refeed sensor turns on.

The specified time Td is set to satisfy the following formula (1).

$$Vu \times Td + Vu^2/(2 \times |\alpha|) + Dr = Dsr + Dt \quad (1)$$

In this formula, $\alpha$ is acceleration of the paper refeed rollers 51 and the relay rollers 45. Dr is a distance set as a conveyance distance of the sheet P at the abutting speed Vm. Dsr is the distance from the refeed sensor 53 to the registration rollers 54 on the conveyance route. Dt is a specific slack amount of the sheet P.

A situation where the specific time Td satisfies the formula (1) means that the sheet P can stop while abutting on the registration rollers 54 with a slack of the specified slack amount Dt formed, at the end of the deceleration abutting operation which starts after the specified time Td elapses from the turning on of the refeed sensor 53.

When the second printer controller 61 determines that it is not the deceleration start timing (step S13: NO), the second printer controller 61 repeats step S13.

When the second printer controller 61 determines that it is the deceleration start timing (step S13: YES), in step S14, the second printer controller 61 outputs a deceleration start instruction to the intermediate device controller 47. Specifically, the second printer controller 61 switches the level of a relay roller timing control signal illustrated in FIG. 4 from a high level to a low level (time t12 of FIG. 4). The relay roller timing control signal is a signal including the deceleration start instruction and an assisting start instruction. The second printer controller 61 outputs the relay roller timing control signal to the intermediate device controller 47 via the communication line 8.

Moreover, in step S14, the second printer controller 61 controls the paper refeed rollers 51 such that the paper refeed rollers 51 perform the deceleration abutting operation. Specifically, the second printer controller 61 starts to reduce the conveyance speed by the paper refeed rollers 51 from the receiving speed Vu at the deceleration start timing (time t12 of FIG. 4). When the conveyance speed by the paper refeed rollers 51 is reduced to the abutting speed Vm, the second printer controller 61 maintains the conveyance speed at the abutting speed Vm from that moment. The sheet P abuts on the registration rollers 54 during the conveyance at the abutting speed Vm. When the conveyance distance at the abutting speed Vm reaches the distance Dr set in advance, the second printer controller 61 starts to reduce the conveyance speed by the paper refeed rollers 51 from the abutting speed Vm. Then, the second printer controller 61 stops the paper refeed rollers 51 (time t13 of FIG. 4).

Meanwhile, after the drive start of the relay rollers 45, in step S2 of FIG. 5, the intermediate device controller 47 determines whether the deceleration start instruction is inputted from the second printer controller 61. When the intermediate device controller 47 determines that no deceleration start instruction is inputted (step S2: NO), the intermediate device controller 47 repeats step S2.

When the intermediate device controller 47 determines that the deceleration start instruction is inputted (step S2: YES), in step S3, the intermediate device controller 47 controls the relay rollers 45 such that the relay rollers 45 perform the deceleration abutting operation. Specifically, the intermediate device controller 47 operates the relay rollers 45 in synchronization with the paper refeed rollers 51 from the deceleration start timing (time t12 of FIG. 4) and stops the relay rollers 45 (time t13 of FIG. 4).

The deceleration abutting operation of the paper refeed rollers 51 and the relay rollers 45 causes the sheet P to abut on the registration rollers 54 and stop with a slack of the specified slack amount Dt formed. As a result, skewing of the sheet P is corrected.

Thereafter, in step S15 of FIG. 6, the second printer controller 61 determines whether it is a registration roller drive start timing. The registration roller drive start timing is a timing after a predetermined time elapses from the end of the deceleration abutting operation by the paper refeed rollers 51 and the relay rollers 45. When the second printer controller 61 determines that it is not the registration roller drive start timing (step S15: NO), the second printer controller 61 repeats step S15.

When the second printer controller 61 determines that it is the registration roller drive start timing (step S15: YES), in step S16, the second printer controller 61 outputs an assisting operation start instruction to the intermediate device controller 47. Specifically, the second printer controller 61 switches the level of the relay roller timing control signal from the low level to the high level (time t14 of FIG. 4).

Moreover, in step S16, the second printer controller 61 starts the drive of the registration rollers 54 (time t14 of FIG. 4). Thereafter, the second printer controller 61 controls the registration rollers 54 such that the registration rollers 54 operate as in the aforementioned operation of the registration rollers 14 in the first printer 2 (time t3 to t6 of FIG. 3). The registration rollers 54 stop when the sheet P passes the registration rollers 54.

Furthermore, in step S16, the second printer controller 61 controls the paper refeed rollers 51 such that the paper refeed rollers 51 perform the assisting operation. Specifically, at the registration roller drive start timing (time t14 of FIG. 4), the second printer controller 61 starts the drive of the paper refeed rollers 51 simultaneously with the registration rollers 54. Thereafter, the second printer controller 61 increases the conveyance speed by the paper refeed rollers 51 to the top speed Vt, maintains the conveyance speed at the top speed Vt for a predetermined time, and then reduces the conveyance speed to the print conveyance speed Vg in synchronization with the registration rollers 54. When the conveyance speed by the paper refeed rollers 51 is reduced to the print conveyance speed Vg, the second printer controller 61 maintains the conveyance speed at the print conveyance speed Vg.

Meanwhile, after the deceleration abutting operation of the relay rollers 45, in step S4 of FIG. 5, the intermediate device controller 47 determines whether the assisting operation start instruction is inputted from the second printer controller 61. When the intermediate device controller 47 determines that no assisting operation start instruction is inputted (step S4: NO), the intermediate device controller 47 repeats step S4.

When the intermediate device controller 47 determines that the assisting operation start instruction is inputted (step S4: YES), in step S5, the intermediate device controller 47 controls the relay rollers 45 such that the relay rollers 45 perform the assisting operation. Specifically, at the registration roller drive start timing (time t14 of FIG. 4), the intermediate device controller 47 starts the drive of the relay rollers 45 simultaneously with the registration rollers 54 and the paper refeed rollers 51. Thereafter, the intermediate device controller 47 increases the conveyance speed by the relay rollers 45 to the top speed Vt and maintains the conveyance speed at the top speed Vt in synchronization with the registration rollers 54 and the paper refeed rollers 51.

Next, in step S6, the intermediate device controller 47 determines whether this sheet P is the last sheet in the executed print job.

When the intermediate device controller 47 determines that this sheet P is not the last sheet (step S6: NO), in step S7, the intermediate device controller 47 changes the conveyance speed by the relay rollers 45 to the receiving speed Vu (time t15 of FIG. 4). Thereafter, the intermediate device controller 47 returns to step S2.

In this case, the intermediate device controller 47 starts to change the conveyance speed by the relay rollers 45 to the receiving speed Vu after a timing at which the sheet trailing edge passes the relay rollers 45. In the example of FIG. 4, the sheet trailing edge passes the relay rollers 45 in a period in which the relay rollers 45 are running at the top speed Vt, and the speed of the relay rollers 45 is changed from the top speed Vt to the receiving speed Vu. When the sheet trailing edge does not pass the relay rollers 45 in the period in which the relay rollers 45 are running at the top speed Vt, the speed of the relay rollers 45 is reduced to the print conveyance speed Vg like the registration rollers 54 and the paper refeed rollers 51. The assisting operation by the relay rollers 45 is performed in synchronization with the operation of the paper refeed rollers 51 until the sheet trailing edge passes the relay rollers 45.

In step S6 of FIG. 5, when the intermediate device controller 47 determines that this sheet P is the last sheet (step S6: YES), in step S8, the intermediate device controller 47 stops the relay rollers 45 when the sheet P passes the relay rollers 45. The control of series of operations of the relay rollers 45 is thus completed.

In this case, an operation pattern program of the deceleration abutting operation and the assisting operation of the relay rollers 45 is installed in advance in the intermediate device controller 47. The intermediate device controller 47 controls the relay rollers 45 based on the relay roller timing control signal from the second printer controller 61, such that the relay rollers 45 perform the deceleration abutting operation and the assisting operation as described above.

In the second printer 4, in step S17 subsequent to step S16 of FIG. 6, the second printer controller 61 determines whether this sheet P is the last sheet.

When the second printer controller 61 determines that this sheet P is not the last sheet (step S17: NO), in step S18, the second printer controller 61 changes the conveyance speed by the paper refeed rollers 51 to the receiving speed Vu (time t16 of FIG. 4). Thereafter, the second printer controller 61 returns to step S12.

In step S17 of FIG. 6, when the second printer controller 61 determines that this sheet P is the last sheet (step S17: YES), in step S19, the second printer controller 61 stops the paper refeed rollers 51. Thereafter, when the registration rollers 54 are stopped, the control of a series of operations of the paper refeed rollers 51 and the registration rollers 54 is completed.

The processes of the flowcharts in FIGS. 5 and 6 cause the relay rollers 45, the paper refeed rollers 51, and the registration rollers 54 to operate as in FIG. 4, and the sheets P are thereby sequentially conveyed to the printing unit 56.

The sheet P conveyed to the printing unit 56 is subjected to printing on the back side by the head unit 67 while being conveyed by the belt platen 66. The sheet P subjected to printing by the printing unit 56 is discharged to the paper receiving tray 60 by the paper discharge rollers 57 and 58.

In the aforementioned description of the operations in duplex printing, description is given of the case where the size of the sheet P is equal to or greater than the predetermined size. In the case where the size of the sheet P is smaller than the predetermined size, the deceleration abutting operation and the assisting operation of the relay rollers 45 in synchronization with the paper refeed rollers 51 are not performed. Specifically, in the case where the size of the sheet P is such a size that the sheet P has already passed the relay rollers 45 (is not nipped by the relay rollers 45) when the sheet P abuts on the registration rollers 54, the relay rollers 45 are continuously driven at the receiving speed Vu. In other words, the intermediate device controller 47 performs control such that the deceleration abutting operation and the assisting operation of the relay rollers 45 in synchronization with the paper refeed rollers 51 are performed depending on the sheet size.

Next, operations in the case where simplex printing is performed in the print system 1 are briefly described.

When the simplex printing is performed, in the first printer 2, printing is performed on the front side of the sheet P by performing operations similar to the aforementioned operations in the duplex printing. The printed sheet P is conveyed to the second printer 4 via the turn-over route RR of the intermediate device 3. In the second printer 4, the sheet P is conveyed along the downstream conveyance route RD without being subjected to printing and is discharged to the paper receiving tray 60. Note that the printing may be performed in the second printer 4 instead of the first printer 2. Moreover, the sheet P discharged from the first printer 2 may be conveyed to the second printer 4 via the non-turn-over intermediate route RC of the intermediate device 3 without being turned over.

As described above, in the print system 1, the second printer controller 61 controls the operations of the paper refeed rollers 51 and the registration rollers 54 based on the timing at which the refeed sensor 53 detects the sheet P. The paper refeed rollers 51 and the registration rollers 54 can be thereby operated in synchronization with the timing at which the sheet P arrives at the second printer 4. Accordingly, it is possible to reduce sheet jam caused by a difference between the timing at which the conveyed sheet P arrives and the operation timing of the paper refeed rollers 51 and the registration rollers 54. As a result, it is possible to reduce operation stop due to sheet jam and thereby suppress a decrease in productivity of printed sheets.

Moreover, the intermediate device controller 47 performs control such that the relay rollers 45 perform the deceleration abutting operation and the assisting operation depending on the sheet size, in synchronization with the deceleration abutting operation and the assisting operation executed based on the timing at which the refeed sensor 53 detects the sheet P. Specifically, in the case where the size of the sheet P is such a size that the trailing edge portion of the sheet P does not pass the relay rollers 45 when the sheet P abuts on the registration rollers 54, the intermediate device controller 47 performs control such that the relay rollers 45 perform the deceleration abutting operation and the assisting operation in synchronization with the paper refeed rollers 51. This can reduce slack and stretch in the sheet P held by both the relay rollers 45 and the paper refeed rollers 51. As a result, the sheet jam can be further reduced.

Moreover, the intermediate device controller 47 controls the relay rollers 45 based on the relay roller timing control signal from the second printer controller 61 such that the relay rollers 45 perform the deceleration abutting operation and the assisting operation according to the operation pattern program installed in advance. Accordingly, the relay rollers 45 of the intermediate device 3 can by synchronized with the paper refeed rollers 51 of the second printer 4 by using a signal from the second printer 4 with low communication traffic. Accordingly, response delay of the relay rollers 45 due to communication can be reduced. Moreover, a change in the distance between the intermediate device 3 and the second printer 4 can be handled without changing the basic control.

In the embodiment described above, description is given of the configuration in which rollers (pre-registration rollers) upstream of the registration rollers 54 in the second printer 4 include only one pair of the paper refeed rollers 51. However, a configuration in which multiple pairs of rollers are provided upstream of the registration rollers 54 may be employed. In this case, each pair of rollers upstream of the registration rollers 54 may be operated as in the aforementioned operations of the paper refeed rollers 51.

Moreover, in the case where multiple pairs of rollers nip the sheet P in the intermediate device 3 when the sheet P abuts on the registration rollers 54 in the second printer 4, all of these multiple pairs of rollers may be controlled to perform the deceleration abutting operation and the assisting operation in synchronization with the paper refeed rollers 51.

Furthermore, in the embodiment described above, the second printer 4 performs face-up paper discharge in which the sheet P is discharged with the side printed by the printing unit 56 facing upward. However, the second printer 4 may be provided with an optional device capable of selecting the face-up paper discharge or face-down paper discharge in which the sheet P is discharged with the side printed by the printing unit 56 facing downward.

Moreover, in the embodiment described above, description is given of the print system including two printers and one intermediate device arranged between the two printers. However, the numbers of printers and intermediate devices are not limited those in the embodiment. The print system may include three or more printers and multiple intermediate devices. In this case, operations similar to those in the second printer 4 in the aforementioned embodiment may be performed in the printers other than the most-upstream printer. Moreover, operations similar to those in the intermediate device 3 in the aforementioned embodiment may be performed in each intermediate device. Furthermore, the aforementioned optional device may be provided in the most-downstream printer.

Furthermore, the present invention can be applied to a printing system in which the intermediate device is omitted and multiple printers are connected in series (in tandem). In this case, the operations similar to those in the second printer 4 in the aforementioned embodiment may be performed in the printers other than the most-upstream printer.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. A print system comprising:

a first printer configured to perform printing on a sheet while conveying the sheet;

a second printer configured to receive the sheet conveyed from the first printer and perform printing on the sheet while conveying the sheet; and at least one intermediate device arranged between the first printer and the second printer and configured to convey the sheet between the first printer and the second printer, wherein the first printer comprises:

a first printing unit configured to perform the printing on the sheet;

a first registration roller configured to convey the sheet to the first printing unit;

at least one first pre-registration roller configured to convey the sheet to the first registration roller; and a first controller configured to control the first printing unit, the at least one first pre-registration roller, and the first registration roller, the first controller configured to drive the at least one first pre-registration roller to allow the sheet to abut on the first registration roller and then drive the first registration roller to convey the sheet to the first printing unit while driving the at least one first pre-registration roller to assist conveyance of the sheet by the first registration roller, the second printer comprises:

a second printing unit configured to perform the printing on the sheet;

a second registration roller configured to convey the sheet to the second printing unit;

at least one second pre-registration roller configured to convey the sheet to the second registration roller;

a sheet detector arranged upstream of the second registration roller in a sheet conveyance direction and configured to detect the sheet; and a second controller configured to control the second printing unit, the at least one second pre-registration roller, and the second registration roller, the second controller configured to drive the at least one second pre-registration roller to allow the sheet to abut on the second registration roller and then drive the second registration roller to convey the sheet to the second printing unit while driving the at least one second pre-registration roller to assist conveyance of the sheet by the second registration roller, wherein the second controller is configured to control an operation of the at least one second pre-registration roller and an operation of the second registration roller based on a timing of a detection of the sheet by the sheet detector, the at least one intermediate device comprises:

at least one conveyance roller configured to convey the sheet to the second printer arranged downstream of and adjacent to the at least one intermediate device; and an intermediate device controller configured to control the at least one conveyance roller, wherein when a size of the sheet being conveyed is equal to or greater than a predetermined sheet size for printing, the intermediate device controller is configured to drive the at least one conveyance roller to perform a deceleration abutting operation to allow the sheet to abut on the second registration roller, and an assisting operation driving the at least one conveyance roller in synchronization with the operation of the at least one second pre-registration roller and the second registration roller to assist with the conveyance of the sheet toward the second printing unit, and the predetermined sheet size is such a size that a trailing edge portion of the sheet does not pass the at least one conveyance roller when the sheet abuts on the second registration roller.

2. The print system of claim 1, wherein the second controller is configured to determine a deceleration start timing of the deceleration abutting operation, the deceleration start timing begins after a specified time elapses from when the sheet detector detects the sheet, and when the second controller determines that the deceleration start timing begins, the second controller outputs a deceleration start instruction to the intermediate device controller.

3. A print system comprising:

a first printer configured to perform printing on a sheet while conveying the sheet;

a second printer configured to receive the sheet conveyed from the first printer and perform printing on the sheet while conveying the sheet; and at least one intermediate device arranged between the first printer and the second printer and configured to convey the sheet between the first printer and the second printer, wherein the first printer comprises:

a first printing unit configured to perform the printing on the sheet;

a first registration roller configured to convey the sheet to the first printing unit;

at least one first pre-registration roller configured to convey the sheet to the first registration roller; and a first controller configured to control the first printing unit, the at least one first pre-registration roller, and the first registration roller, the first controller configured to drive the at least one first pre-registration roller to allow the sheet to abut on the first registration roller and then drive the first registration roller to convey the sheet to the first printing unit while driving the at least one first pre-registration roller to assist conveyance of the sheet by the first registration roller, the second printer comprises:

a second printing unit configured to perform the printing on the sheet;

a second registration roller configured to convey the sheet to the second printing unit;

at least one second pre-registration roller configured to convey the sheet to the second registration roller;

a sheet detector arranged upstream of the second registration roller in a sheet conveyance direction and configured to detect the sheet; and a second controller configured to control the second printing unit, the at least one second pre-registration roller, and the second registration roller, the second controller configured to drive the at least one second pre-registration roller to allow the sheet to abut on the second registration roller and then drive the second registration roller to convey the sheet to the second printing unit while driving the at least one second pre-registration roller to assist conveyance of the sheet by the second registration roller, wherein the second controller is configured to control an operation of the at least one second pre-registration roller and an operation of the second registration roller based on a timing of a detection of the sheet by the sheet detector, the at least one intermediate device comprises:

at least one conveyance roller configured to convey the sheet to the second printer arranged downstream of and adjacent to the at least one intermediate device; and an intermediate device controller configured to control the at least one conveyance roller, wherein when a size of the sheet being conveyed is equal to or greater than a predetermined sheet size for printing, the intermediate device controller is configured to drive the at least one conveyance roller to perform a deceleration abutting operation to allow the sheet to abut on the second registration roller, and an assisting operation driving the at least one conveyance roller in synchronization with the operation of the at least one second pre-registration roller and the second registration roller to assist with the conveyance of the sheet toward the second printing unit, the predetermined sheet size is such a size that a trailing edge portion of the sheet does not pass the at least one conveyance roller when the sheet abuts on the second registration roller, the second controller is configured to determine a deceleration start timing of the deceleration abutting operation, the deceleration start timing begins after a specified time elapses from when the sheet detector detects the sheet, where the specified time satisfies the following formula:

$$Vu \times Td + Vu2/(2 \times |\alpha|) + Dr = Dsr + Dt$$

where:

Td is the specified time,

Vu is a receiving speed of the sheet to the at least one second pre-registration roller, $\alpha$ is an acceleration of the at least one second pre-registration roller and the at least one conveyance roller, Dr is a distance set as a conveyance distance of the sheet at an abutting speed, Dsr is a distance from the sheet detector to the second registration roller, and Dt is a specific slack amount of the sheet, and when the second controller determines that the deceleration start timing begins, the second controller outputs a deceleration start instruction to the intermediate device controller.

* * * * *